US005351816A

United States Patent [19]

Sutherland et al.

[11] Patent Number: 5,351,816

[45] Date of Patent: Oct. 4, 1994

[54] NECK CLIP BOTTLE CARRIER WITH MEANS FACILITATING BOTTLE REMOVAL

[75] Inventors: Robert L. Sutherland, Kennesaw; James C. Fogle, Marietta, both of Ga.

[73] Assignee: Riverwood International Corporation, Atlanta, Ga.

[21] Appl. No.: 136,522

[22] Filed: Oct. 14, 1993

[51] Int. Cl.[5] ..... B65D 75/00

[52] U.S. Cl. ..... 206/153; 206/147; 206/158; 294/87.2

[58] Field of Search ..... 206/145, 147, 151, 152, 206/153, 158, 161, 162, 194; 294/87.2

[56] References Cited

U.S. PATENT DOCUMENTS

| | | | |
|---|---|---|---|
| 3,860,281 | 1/1975 | Wood | 206/158 |
| 4,180,191 | 12/1979 | Wood | 294/87.2 |
| 4,305,500 | 12/1981 | Jaeschke | 206/158 |
| 4,318,476 | 3/1982 | Wood et al. | 206/153 |
| 4,372,599 | 2/1983 | Kiedaisch et al. | 294/87.2 |
| 4,378,879 | 4/1983 | Killy | 206/158 |
| 4,403,689 | 9/1983 | Wood | 206/158 |
| 5,273,156 | 12/1993 | Harris | 206/153 |

*Primary Examiner*—David T. Fidei

[57] ABSTRACT

A neck clip bottle carrier having angled side panels of two-ply construction. The lower edges of openings in the side panels engage the underside of bottle flanges to support the bottles. The inner and outer plies of the side panels contain tear lines which are aligned with and overlie each other. The tear lines extend at an angle to the vertical from the lower edge of the side panels to a point on the lower support edge of the nearest bottle neck opening. Severance of overlying tear lines in a side panel permits the associated bottle to be removed through the side panel.

8 Claims, 1 Drawing Sheet

NECK CLIP BOTTLE CARRIER WITH MEANS FACILITATING BOTTLE REMOVAL

FIELD OF THE INVENTION

This invention relates to bottle carriers of the neck clip type, wherein the bottles are supported at their necks by an elongated tube-like carrier. More particularly, it relates to a neck clip carrier with improved means for permitting a bottle to be removed.

BACKGROUND OF THE INVENTION

Beverage bottles, particularly large plastic bottles which have a flange or collar on the neck just below the bottle cap, are often packaged in neck clip carriers. Openings in the bottom of the carrier receive the upper portions of the bottles, while the lower edges of bottle neck openings in the sloped side panels engage the underside of the bottle flanges to support the bottles during lifting and carrying. While neck clip carriers provide an economical means for packaging and carrying bottles, it can at times be difficult to remove a bottle from the package. Because the carriers are clipped tightly on the bottles, their side panels cannot readily be pulled apart to move the flange support edges away from the flanges, making it necessary to tear the side panels beneath the flange support edges. The thick paperboard or the two-ply design often used to impart strength to the carriers can be quite difficult to tear.

To overcome this problem carriers have been designed with tear-away sections immediately beneath the flange support edges. One approach, disclosed in U.S. Pat. No. 4,180,191, employs a two-ply design, with aligned tear-away sections in the layers forming one of the side panels. Although this provides access to the bottles, the structural integrity of the carrier is at risk if one or both of the overlying tear-away sections were to prematurely fail due to lifting and carrying stresses. Another approach, disclosed in U.S. Pat. No. 4,318,476, also employs a two-ply design, with the outer ply incorporating a tear-away section. When the tear-away section is removed an easily severed cut line extending vertically from the bottle flange support edge in the underlying layer is revealed. This arrangement also is subject to carrier failure since both the tear-away section of the outer paperboard layer and the vertical cut line in the inner layer are subjected to lifting and carrying forces directed along the tear edges.

It is an object of the invention to provide a neck clip carrier which allows easy access to the bottles without compromising the structural integrity of the carrier.

BRIEF SUMMARY OF THE INVENTION

The invention is used in connection with a neck clip bottle carrier of the type having a bottom panel containing openings for receiving the upper portions of bottles and angled side panels foldably connected to the bottom panel. The upper portions of the side panels contain openings for receiving the necks of bottles, with the lower edges of the openings engaging the underside of bottle neck flanges to support the bottles in the carrier. At least one of the side panels is of two-ply construction, with the inner ply containing an angled easily severed line and the overlying outer ply containing a substantially aligned easily severed line. The easily severed lines extend from a lower portion of the side panel to a point on the lower support edge of the nearest bottle neck opening. When these lines are severed, the adjacent bottle can readily be moved past the unsupported edges of the side panel plies created by the severing step.

The inner ply of the side panel may include a tab extending below the overlying outer ply, with the easily severed line in the inner ply terminating substantially at an edge of the tab. The upper ends of the easily severed lines preferably terminate at a central portion of the lower support edge of the nearest bottle neck opening.

The angled nature of the tear lines resists failure from vertical forces generated by the stresses resulting from lifting and carrying, thus preserving the structural integrity of the carrier. The invention may be employed with any design of neck clip carrier of the general type described which has at least one side panel of two-ply construction. Carriers incorporating the invention can be formed from a blank of minimal size by standard erection procedures.

The above and other aspects and benefits of the invention will readily be apparent from the more detailed description of the preferred embodiment of the invention which follows.

DETAILED DESCRIPTION OF THE PREFERRED EMBODIMENT

Figure 1:
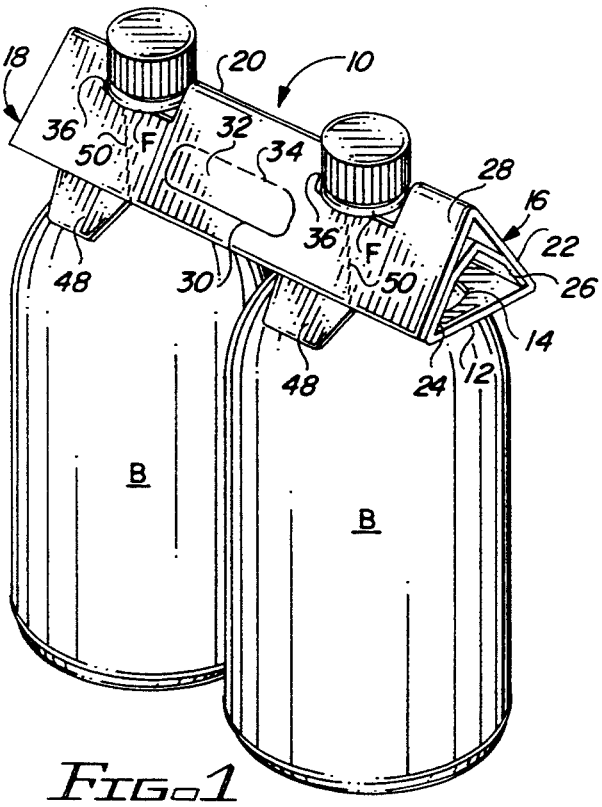
FIG. 1 is a pictorial view of the neck clip carrier of the invention, illustrated as a two-bottle carrier.

Referring to FIG. 1, the illustrated neck clip carrier 10 is designed to hold two bottles B. The carrier includes a bottom panel 12, which contains cutouts 14 for receiving the bottles, and side panels 16 and 18, which are angled toward each other from the side edges of the bottom panel, meeting at the upper central fold line 20. The side panels are of double layer construction, with the outer ply 22 of side panel 16 being foldably connected to one side edge of bottom panel 12 and the inner ply 24 of side panel 18 being foldably connected to the other side edge. The inner ply 24 of side panel 18 is connected by a fold line lying directly beneath the fold line 20 to the inner ply 26 of side panel 16, while the outer ply 28 of side panel 18 is connected to the outer ply 22 of side panel 16 by the fold line 20. Handle openings are provided in both plies of the side panels between the bottles to assist in lifting the carrier. The illustrated handle opening 30 in the outer ply 28 is covered by flap 32, which is connected to the outer ply by fold line 34.

Figure 2:
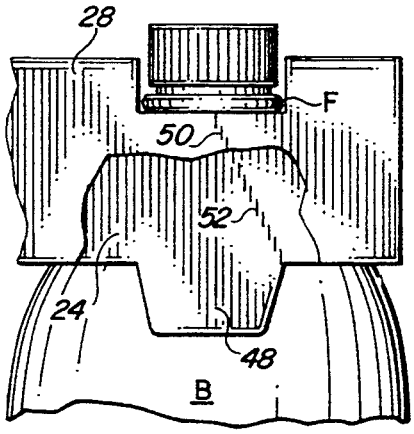
FIG. 2 is an enlarged partial side view of the carrier, illustrating an end portion of the carrier of FIG. 1.

Each side panel includes a bottle neck opening or cutout 36 that interrupts the central fold line 20 opposite the location of a bottle, and each cutout has a lower edge that engages the underside of the flange F of a bottle to support the bottles when lifted. Each lower edge of the cutouts is comprised of the adjacent edges of the cutouts in adjacent inner and outer plies of the side panels. The inner ply 24 additionally includes two tabs 48 which extend down beyond the bottom panel 12. An easily severed line 50 extends at an angle from the end of the outer ply 28 to the associated bottle neck cutout 36. As shown in FIG. 2, the inner ply 24 also includes an easily severed line 52 which extends from the outer side of the tab 48 to the bottle neck opening 36. The line 52 is aligned with and located substantially directly beneath the line 50.

Figure 3:
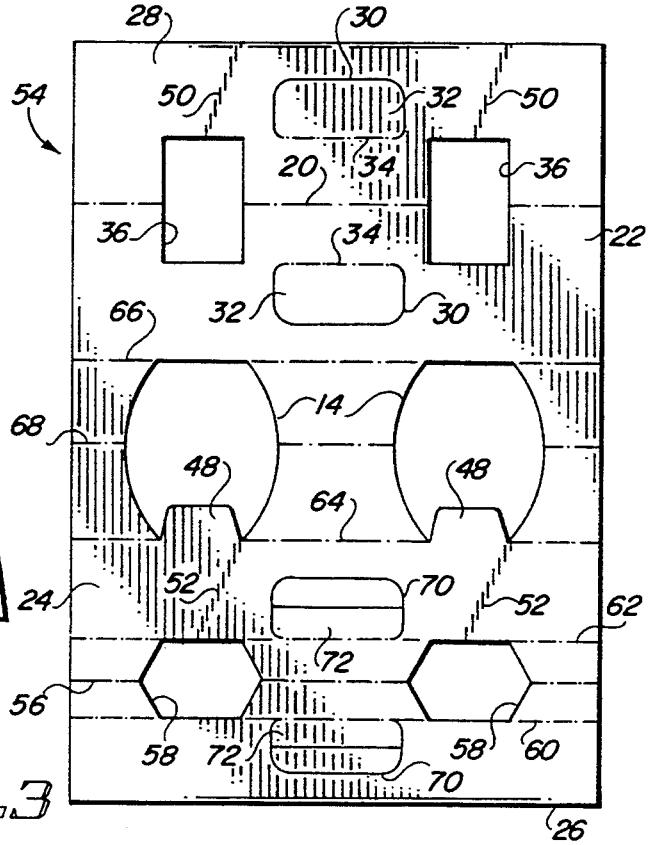
FIG. 3 is a plan view of a blank used to form the carrier.

Referring now to FIG. 3, wherein like reference numerals to those used in FIGS. 1 and 2 refer to similar elements, a blank 54 for forming the neck clip carrier of FIG. 1 is comprised of a sheet of flexible, foldable material such as conventional paperboard used in the carrier industry. At the lower end of the blank, as viewed in the drawing, is inner ply section 26 which is connected to the other inner ply section 24 along fold line 56. The fold line 56 is interrupted by the cutouts 58, half of each cutout extending into the inner ply section 24 and half into the inner ply section 26. Score lines 60 and 62 extend between the outer edges of the cutouts to facilitate the flexing that occurs when a collapsed carrier is installed on bottles to be packaged.

The inner ply panel section 24 is connected at its other end along fold line 64 to the bottom panel section 12, which in turn is connected along fold line 66 to outer ply panel section 22. A median fold line 68 in the bottom panel section 12 is interrupted by the spaced bottle cutouts 14, the fold line 66 is interrupted by the ends of the bottle cutouts, and the fold line 64 is interrupted by the tabs 48 which extend into the cutout area from the inner ply section 24. The outer ply panel section 22 is connected to the other outer ply panel section 28 along the center fold line 20, which is interrupted by the cutouts 36, half of each cutout extending into the outer ply section 22 and half into the outer ply section 28. The handle openings 30 and covering flaps 32 are in the outer ply sections, while handle openings 70 and flaps 72 are in the inner ply sections. The handle flaps 72, which are connected to the inner ply sections along the fold lines 62, may be shorter than the handle flaps 32, as illustrated, so that they can bridge between the side panels of the carrier to provide a handle strap section during carrying.

The tear lines 50 extend from the midpoint of the outer support edge of the bottle neck cutouts 36 to the outer edge of the blank at an angle to the side edges of the blank. The tear lines 52 extend from the midpoint of the inner edge of the bottle neck cutouts 58 to the right edge of the tabs 48, as viewed in FIG. 3.

A carrier is formed from the blank in conventional manner by first folding the inner ply section 26 about the fold line 56 so as to bring the section 26 into contact with the inner ply section 24, then folding the folded lower portion of the blank about the fold line 68 in the bottom panel section 12. Glue adheres the folded inner ply section 26 to the outer ply section 22. The outer ply panel section 28 is then folded down and adhered by glue to the inner ply section 24.

The resulting collapsed carrier is applied in conventional manner to bottles arranged so as to be aligned with the openings in the bottom panel by moving the collapsed carrier down over the bottles. The fold lines 68 in the bottom panel 12 and the fold lines 60 and 62 in the inner side panel sections 24 and 26 allow the side panels to flex away from each other as they are forced out by relative movement between the carrier and the bottles. Relative movement is continued until the flanges F on the bottles pass the lower locking or support edges of the side panel cutouts, thereby allowing the side panels to snap into position beneath the flanges to form the finished package of FIG. 1.

Figure 4:
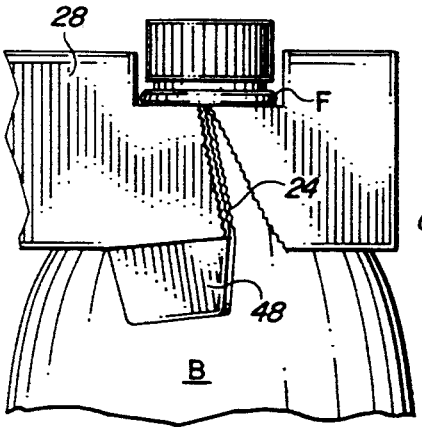
FIG. 4 is an enlarged partial side view of the carrier similar to the view of FIG. 2, but showing the end portion after the side panel plies have been separated along the easily severed lines.

Referring back to FIG. 2, the tear lines 50 and 52 in overlying plies 28 and 24 are aligned with each other and extend from the outer edge of the tab 48 to the midpoint of the bottle neck opening 36. To remove a bottle from the carrier the tab 48 is grasped and pulled or twisted to the left, as viewed in the drawing. Since the tear lines 50 and 52 are aligned, both are severed by this force. FIG. 4 illustrates the limited movement of the side panel adjacent the tear lines in carrying out this severing procedure. The bottle can now be pulled from the carrier through the severed opening. As the bottle is pulled through, the relatively narrow neck of the bottle readily pushes the side panel portions adjacent the severed edges out from the plane of the side panel a sufficient amount to permit the neck to pass through.

Because the tear lines are angled with respect to the vertical, they are not in danger of failing when the carrier is subjected to typical vertically directed lifting forces. This is contrary to prior art tear strip arrangements in which one or two tear lines vertically extend from the edge of the bottle neck cutout to the lower end of the side panel, thereby being susceptible to failure from such forces. Although the particular angle of the aligned tear lines may vary, the lower end of the inner ply tear line 52 should be at the edge of the tab 48 or spaced inwardly from the edge a small enough distance that the portion of the tab between the tear line and the end of the tab is readily separated when the tab is pulled. The upper ends of the tear lines should terminate at the lower edge of the cutout 36. Preferably the upper ends terminate at or near the midpoint of the lower edge of the cutout 36 so that the upper ends of the flaps created by the tear line severance may have equal distances to be moved by the bottle as the bottle pushes the flaps to the side during removal. If the tear lines terminate close to an end of the bottle neck cutout, the flap extending from that end will tend to resist movement of the bottle and make it more difficult to remove. Moreover, if the tear lines terminate too close to the nearest end of the bottle neck cutout, the angle they make with the vertical becomes less, making the tear lines less resistant to excessive vertical forces.

Although the tear lines are shown in the drawing as angling up toward the left in the side panels, it will be understood that they could just as well be made to angle up toward the right. If desired, different pairs of tear lines can be made to extend in different directions, since bottle removal will be facilitated regardless of the particular direction of the tear lines. For example, carriers can be made with the tear lines in one side panel angled in the opposite direction to those in the other side panel, allowing right- or left-handed users to choose the side to open which is most convenient for them.

The carrier design permits the use of tear lines without compromising the structural integrity of the carrier. Although the invention has been illustrated in connection with a neck clip carrier adapted to support bottles having flanges located at a point below the cap, it will be understood that it may also be used with other bottle designs as well, as long as they have a flange-like projection or shoulder which the support edges of the cutouts can engage. In this connection, the term "flange", as used in the specification and claims, is intended to encompass all types of flanges or flange-like projections engaged by the support edges of the side panel cutouts. In addition, although described in connection with a two-bottle carrier having hand openings in the side panels, the principles of the invention will apply equally to neck clip carriers of other designs, such as carriers adapted to carry greater numbers of bottles and carriers having separate handle panels extending up from the side panels.

It should now be appreciated that the invention provides a means for facilitating removal of bottles one at a time from a two-ply neck clip carrier without compromising the structural integrity of the carrier and without requiring a more expensive production blank.

It should be apparent that the invention is not necessarily limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A neck clip bottle carrier, comprising:

a bottom panel having openings therein for receiving the necks of bottles;

side panels connected to the bottom panel along fold lines, the side panels being angled toward each other;

at least one side panel being comprised of inner and outer plies of material;

the upper portions of the side panels containing openings for receiving the necks of bottles, the openings including lower edges for engaging the underside of outwardly extending flanges on the bottle necks to support the bottles in the carrier;

each of the inner and outer plies of said one side panel including a single easily severed line associated with each bottle neck opening in said one side panel, the easily severed line being angled from a lower portion of said one side panel to a point on the lower edge of said associated bottle neck opening, the easily severed line in the outer ply of said one side panel being substantially aligned with and overlying the easily severed line in the inner ply of said one side panel; and a tab extending from the inner ply of said one side panel adjacent each easily severed line of the inner and outer plies, the tab extending below the overlying outer ply.

2. A neck clip bottle carrier as defined in claim 1, wherein the easily severed line in the inner ply of said one side panel terminates substantially at the fold line connecting the inner ply to the bottom ply.

3. A neck clip bottle carrier as defined in claim 1, wherein the easily severed line in the inner ply terminates substantially at an edge of the tab.

4. A neck clip bottle carrier as defined in claim 1, wherein the point on the lower edge of said bottle neck opening at which the easily severed lines in the inner and outer plies terminate is spaced from the ends of said lower edge.

5. In a neck clip bottle carrier of the type comprised of a bottom panel having openings therein for receiving the necks of bottles, side panels connected to the bottom panel and being angled toward each other, the upper portions of the side panels containing openings for receiving the necks of bottles, the openings including lower edges for engaging the underside of outwardly extending flanges on the bottle necks to support the bottles in the carrier, and at least one side panel being comprised of inner and outer plies of material, the improvement comprising:

each of the inner and outer plies of said one side panel including a single easily severed line associated with each bottle neck opening in said one side panel the easily severed line being angled from a lower portion of said one side panel to a point on the lower edge of said associated bottle neck opening, the easily severed line in the outer ply of said one side panel being substantially aligned with and overlying the easily severed line in the inner ply of said one side panel; and a tab extending from the inner ply of said one side panel adjacent each easily severed line of the inner and outer plies, the tab extending below the overlying outer ply.

6. A neck clip bottle carrier as defined in claim 5, wherein the easily severed line in the inner ply of said one side panel terminates substantially at the fold line connecting the inner ply to the bottom ply.

7. A neck clip bottle carrier as defined in claim 5, wherein the point on the lower edge of said bottle neck opening at which the easily severed lines in the inner and outer plies terminate is spaced from the ends of said lower edge.

8. A neck clip bottle carrier, comprising:

a bottom panel having openings therein for receiving the necks of bottles;

side panels connected to the bottom panel along fold lines, the side panels being angled toward each other;

at least one side panel being comprised of inner and outer plies of material;

the upper portions of the side panels containing openings for receiving the necks of bottles, the openings including lower edges for engaging the underside of outwardly extending flanges on the bottle necks to support the bottles in the carrier;

the inner and outer plies of said one side panel including an easily severed line angled from a lower portion of said one side panel to a point on the lower edge of the nearest bottle neck opening in the upper portion of said side panel, the easily severed line in the outer ply of said one side panel being substantially aligned with and overlying the easily severed line in the inner ply of said one side panel; and the point on the lower edge of said bottle neck opening at which the easily severed lines in the inner and outer plies terminate is at substantially the midpoint of said lower edge.

* * * * *